US005207078A

United States Patent [19]

Kimura et al.

[11] Patent Number: 5,207,078

[45] Date of Patent: May 4, 1993

[54] RECIPROCATORY PISTON TYPE COMPRESSOR FOR A REFRIGERATION SYSTEM

[75] Inventors: Kazuya Kimura; Hiroaki Kayukawa, both of Kariya, Japan

[73] Assignee: Kabushiki Kaisha Toyoda Jidoshokki, Aichi, Japan

[21] Appl. No.: 936,616

[22] Filed: Aug. 27, 1992

[30] Foreign Application Priority Data

Sep. 2, 1991 [JP] Japan ..... 3-221820

[51] Int. Cl.[5] ..... F04B 1/14

[52] U.S. Cl. ..... 62/509; 62/197; 417/222.2; 417/269

[58] Field of Search ..... 417/222.1, 222.2, 269; 62/509, 197

[56] References Cited

U.S. PATENT DOCUMENTS 2,160,978 6/1939 Mock ..... 417/269
4,745,777 5/1988 Morishita et al. ..... 62/509

FOREIGN PATENT DOCUMENTS 957030 2/1950 France ..... 417/269
35082 2/1987 Japan ..... 417/269
175557 8/1987 Japan ..... 417/269

*Primary Examiner*—Leonard E. Smith
*Attorney, Agent, or Firm*—Burgess, Ryan & Wayne

[57] ABSTRACT

A reciprocatory piston type compressor having a cylinder block provided with a plurality of cylinder bores in which a refrigerant gas drawn from a suction chamber is compressed and discharged toward a discharge chamber from which the compressed refrigerant gas is delivered to a refrigeration system. The compressor further having an injection gas passageway for introducing a refrigerant gas at a relatively high pressure therein from a liquid-gas divider of the refrigeration system, and a rotary valve element rotated with a drive shaft of the compressor for equivalently injecting the high pressure refrigerant gas into every cylinder bore at a selected time and the compression of the refrigerant occurs in each cylinder bore.

4 Claims, 4 Drawing Sheets

RECIPROCATORY PISTON TYPE COMPRESSOR FOR A REFRIGERATION SYSTEM

BACKGROUND OF THE INVENTION

1. Field of the Invention

The present invention relates to a reciprocatory piston type compressor adapted for a refrigeration system of e.g., an automobile air-conditioner. More particularly, it relates to a swash plate-operated refrigerant compressor capable of utilizing an injection of a refrigerant gas from a liquid-gas divider o a refrigeration system to enhance compressor discharge performance during the compression of refrigerant gas returning from an evaporator of the refrigeration system.

2. Related Art

A refrigeration system of an automobile air-conditioner includes a refrigerant compressor such as a fixed capacity swash plate-operated double-headed axial piston type compressor and a variable capacity swash plate-operated single-headed axial piston type compressor.

FIG. 6 illustrates a known refrigeration system including an evaporator 55, a refrigerant compressor 50 delivering therefrom a high pressure and high temperature refrigerant gas by compressing a refrigerant gas when it returns from the evaporator 55, a condenser 51 for condensing the refrigerant gas after compression when it is sent from the compressor, a first pressure reducer 52 for reducing a pressure level of the condensed refrigerant sent from the condenser 51, a liquid-gas divider 53 for dividing the condensed refrigerant into a refrigerant in the gas form and a refrigerant in the liquid form, and a second pressure reducer 54 for reducing a pressure level of the refrigerant in the liquid form by introducing therein from the liquid-gas divider 53. The pressure reduced liquid refrigerant sent from the second pressure reducer 54 is then evaporated in the evaporator 55 by absorbing heat from an exterior air to thereby cool the air. Namely, the refrigerant compressor 50, the condenser 51, the first pressure reducer 52, the liquid-gas divider 53, the second pressure reducer 54 and the evaporator 55 are sequentially connected by refrigerant conduits to form a closed refrigeration system. Further, the refrigerant compressor 50 is connected to the liquid-gas divider 53 by a refrigerant conduit 56 to introduce the divided refrigerant gas at a relatively high pressure from the liquid-gas divider 53 into the compressor 50. Namely, the high pressure refrigerant gas is injected from the divider 53 into the compressor 50 through the refrigerant conduit 56. The injection of the high pressure refrigerant gas can enhance the discharge performance of the compressor to thereby improve the refrigeration efficiency of the refrigeration system.

The Japanese Unexamined (Kokai) Patent Publication No. 62-175557 discloses a typical construction of the swash plate type refrigerant compressor capable of receiving an injection of the high pressure refrigerant gas from the liquid-gas divider. In accordance with the compressor construction of the above-mentioned Patent Publication No. '557, a cylinder block of the compressor is provided with a plurality of cylinder bores, and a suction chamber fluidly communicated with the cylinder bores via suction valves. The suction chamber has a subsidiary chamber capable of communicating with a particular one of the plurality of cylinder bores and a main suction chamber capable of communicating with the cylinder bores other than the particular cylinder bore. The subsidiary suction chamber is provided with an inlet port connected to an injection conduit so as to receive a high pressure refrigerant gas from the liquid-gas divider. Therefore, the high pressure refrigerant gas is injected from the subsidiary suction chamber into the particular cylinder bore.

Nevertheless, in the above-mentioned compressor of the Japanese Unexamined Patent Publication No. 62-175557, the injection of the high pressure refrigerant gas is given to only one of the plurality of cylinder bores, and accordingly enhancement of the overall discharge performance of the compressor must be limited, and therefore the injection of a high pressure refrigerant gas cannot satisfactorily contribute to an enhancement of the compressor discharge performance.

Further, if an amount of the injection of the high pressure refrigerant gas is increased to enhance the compressor discharge performance, the particular single cylinder bore to which the injection of the high pressure refrigerant gas is applied must be constantly subjected to a high pressure, and therefore such high pressure acts on a discharge valve of the particular cylinder bore to thereby reduce physical durability thereof.

Furthermore, in the case of the refrigerant compressors such as a vane type compressor, a rotary type compressor and a scroll type compressor, it is easy to meet structural requirements for receiving an injection of a high pressure refrigerant gas by employing a relatively simple change in the construction thereto.

Nevertheless, in the case of the reciprocatory piston type compressor, a very complicated construction must be provided for receiving an injection of a high pressure refrigerant gas into each of the plurality of cylinder bores.

SUMMARY OF THE INVENTION

An object of the present invention is therefore to provide a reciprocatory piston type refrigerant compressor capable of enhancing the discharge performance thereof by receiving an injection of a high pressure refrigerant gas whereby an increase in the refrigeration efficiency of a refrigeration system in which the compressor is incorporated can be achieved.

In accordance with the present invention, there is provided a reciprocatory piston type refrigerant compressor to be incorporated in a refrigeration system provided with a condenser condensing a refrigerant, a first pressure reducer reducing a pressure level of the refrigerant condensed by the condenser, a liquid-gas divider diving the refrigerant depressurized by the first pressure reducer into a liquid refrigerant and a refrigerant gas, a second pressure reducer reducing a pressure level of the liquid refrigerant supplied from the liquid-gas divider, an evaporator for evaporating the refrigerant gas depressurized liquid refrigerant, and a refrigerant conduit line for supplying the refrigerant gas from the liquid-gas divider toward the compressor. The compressor is characterized by comprising:

an axially extended cylinder block having a central axis thereof, a central bore extended coaxial with the central axis, and a plurality of axial cylinder bores arranged around the central axis to be parallel with the central axis of the cylinder block; each axial cylinder bore having first and second opposite ends thereof;

front and rear housings air-tightly connected to opposite axial ends of the axially extended cylinder block for defining a suction chamber for the refrigerant before compression, and a discharge chamber for the refrigerant after compression;

a rotatable drive shaft having axial ends thereof rotatably supported by bearings seated in the front housing and the central bore of the cylinder block;

a plurality of reciprocatory pistons fitted in the plurality of axial cylinder bores of the axially extended cylinder block; each piston being slid from the first to second end of one of the plurality of cylinder bores for drawing the refrigerant before compression, and from the second to first end of the same cylinder bore for compressing the drawn refrigerant gas;

a swash plate-operated piston drive mechanism arranged around the drive shaft to be cooperative with the drive shaft for reciprocating the plurality of reciprocatory pistons in the plurality of cylinder bores when the drive shaft is rotated;

first means for providing a constant refrigerant conduit introducing the refrigerant gas supplied from the liquid-gas divider of the refrigeration system into a definite part of the central bore of the cylinder block; and second means for successively creating a radial fluid communication passageway means between the definite part of the central bore of the cylinder block and each of the plurality of cylinder bores at a portion adjacent to the first end thereof in response to the rotation of the drive shaft, the radial fluid communication passageway means permitting an injection of the refrigerant gas from the definite part of the central bore into the portion of each cylinder bore adjacent to the first end thereof when the piston is at a compression stroke thereof.

The second means may comprise a plurality of radial passageways fixedly formed in the cylinder block to provide a constant communication between the central bore and the plurality of cylinder bores of the cylinder block, and a rotary valve element arranged in the central bore of the cylinder block so as to be rotatable together with the drive shaft; the rotary valve element having an end face provided with a single radial passageway recessed in the end face to form a definite part of the central bore; the single radial passageway of the rotary valve element capable of coming into radial alignment with one of the plurality of radial passageways of the cylinder block in response to the rotation of the rotary valve element.

BRIEF DESCRIPTION OF THE DRAWINGS

The above and other objects, features and advantages of the present invention will be made apparent from the ensuing description of preferred embodiments thereof in conjunction with the accompanying drawings wherein.

DESCRIPTION OF THE PREFERRED EMBODIMENT

Figure 1:
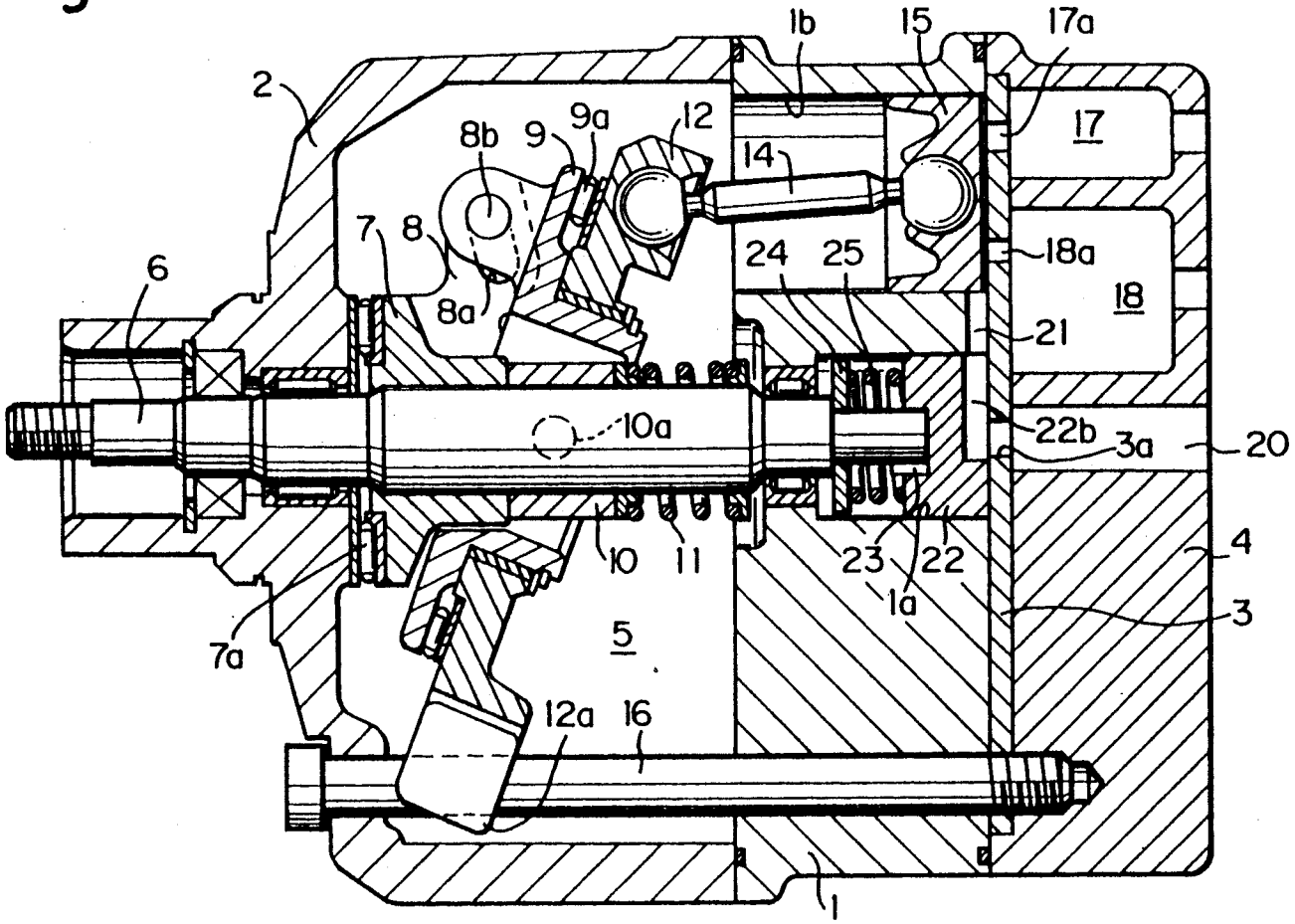
FIG. 1 is a longitudinal cross-sectional view of a variable capacity swash plate type compressor in accordance with an embodiment of the present invention.

Referring to FIG. 1, a swash plate-operated reciprocatory piston type compressor includes an axial cylinder block 1 having a central axis, opposite axial ends, a central bore la extended coaxially with the central axis, and a plurality of (five) cylinder bores 1*b* arranged equiangularly around and in parallel with the central axis. One of the axial ends, i.e., a front end of the cylinder block 1 is air-tightly closed by a front housing 2, and the other end, i.e., a rear end of the cylinder block is air-tightly closed by a rear housing 4 via a valve plate 3. The front housing 2 defines a crank chamber 5 axially extending in front of the front end of the cylinder block 1. The rear housing 4 defines therein a suction chamber 17 for a refrigerant before compression and a discharge chamber 18 for a refrigerant after compression therein.

A drive shaft 6 axially extending through the crank chamber 5 is rotatably supported by bearings seated in a central bore of the front housing 2 and the central bore 1*a* of the cylinder block 1. The drive shaft 6 has a rotor 7 fixedly mounted thereon to be rotated together and axially supported by a thrust bearing 7*a* arranged between an inner end of the front housing 2 and the frontmost end of the rotor 7. The rotor 7 has a support arm 8 extending from a rear part thereof to provide an extension in which an elongated through-bore 8*a* is formed for receiving a lateral pin 8*b* slidably movable in the through-bore 8*a*. The lateral pin 8*b* is connected to a swash plate 9 arranged around the drive shaft so as to be able to change an angle of inclination thereof with respect to a plane perpendicular to the rotating axis of the drive shaft 6.

A sleeve element 10 axially slidably mounted on the drive shaft 6 is arranged adjacent to the rearmost end of the rotor 7, and is constantly urged toward the rearmost end of the rotor 7 by a coil spring 11 arranged around the drive shaft 6 at a rear portion thereof. The sleeve element 10 has a pair of laterally extending trunnion pins 10*a* on which the swash plate 9 is pivoted so as to be inclined thereabout.

The swash plate 9 has an annular rear face and a cylindrical flange to support thereon a non-rotatable wobble plate 12 via a thrust bearing 9*a*. The nonrotatable wobble plate 12 has an outer periphery provided with a guide portion 12*a* in which a long bolt 16 is fitted to prevent any rotational play of the wobble plate 12 on the swash plate 9, and the wobble plate 12 is operatively connected to pistons 15 axially slidably fitted in the cylinder bores 1*b*, via connecting rods 14. When the drive shaft 6 is rotated together with the rotor 7 and the swash plate 9, the wobble plate 12 on the swash plate 9 is non-rotatably wobbled to cause reciprocation of respective pistons 15 in the cylinder bores 1*b*. In response to the reciprocation of the pistons 15, the refrigerant is drawn from the suction chamber 17 into respective cylinder bores 1*b* and compressed therein. The compressed refrigerant is discharged from respective cylinder bores 1*b* toward the discharge chamber 18 from which the refrigerant after compression is delivered to the condenser of a refrigeration system.

During the operation of the compressor, when there appears a change in a pressure differential between a suction pressure in each cylinder bore lb and a pressure prevailing in the crank chamber 5, the stroke of each piston 15 is changed, and therefore, the angle of inclination of the swash plate 9 and the wobble plate 12 is changed. The pressure in the crank chamber 5 is adjustably changed by a conventional solenoid control valve (not shown in FIG. 1) housed in an extended portion of the rear housing 4.

The rear housing 4 having the afore-mentioned suction and discharge chambers 17 and 18 therein is provided with a fluid conduit 20 in the form of a throughbore centrally formed therein to fluidly communicate with the central bore la of the cylinder block 1 via a central bore 3*a* of the valve plate 3. The fluid conduit 20 has an inlet opening formed in the rear end face of the rear housing 4 to introduce a refrigerant gas at a high pressure from a liquid-gas divider of the refrigeration system into the compressor via the fluid conduit 20. Namely, the high pressure refrigerant gas introduced through the fluid conduit 20 is injected into respective cylinder bores 1*b* in a manner that will be described later.

The cylinder block 1 is provided with radial injection passageways 21 formed therein to provide communication between the central bore 1*a* and each of the cylinder bores 1*b*. Each of the radial injection passageways 21 opens into each cylinder bore 1*b* at a rear end portion of that cylinder bore 1*b* where the piston 15 approaches to the top dead center thereof, Further, a rotary valve element 22 in the cylinder form is rotatably arranged in the central bore 1*a* of the cylinder block 1 and fixedly keyed by a key 23 to an end portion of the drive shaft 6 extended into the central bore 1*a*. The rotary valve element 22 is axially constantly urged against an inner face of the valve plate 3 by a coil spring 25 arranged between an end of the rotary valve element 22 and a step-like spring seat of the drive shaft 6.

Figure 2:
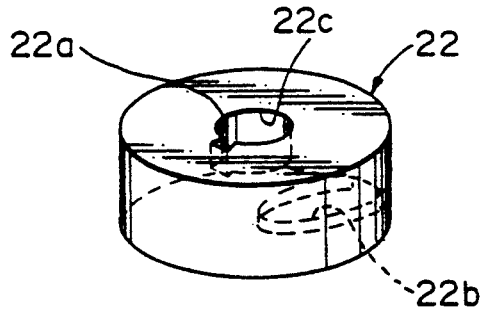
FIG. 2 is a perspective view of a rotary valve element accommodated in the compressor of FIG. 1, illustrating a key way and an axial hole formed in one end face thereof.
Figure 3:
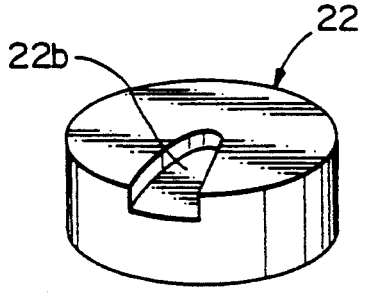
FIG. 3 is another perspective view of the same rotary valve element as that of FIG. 2, illustrating a radial passageway recessed in the other end face thereof.
Figure 4:
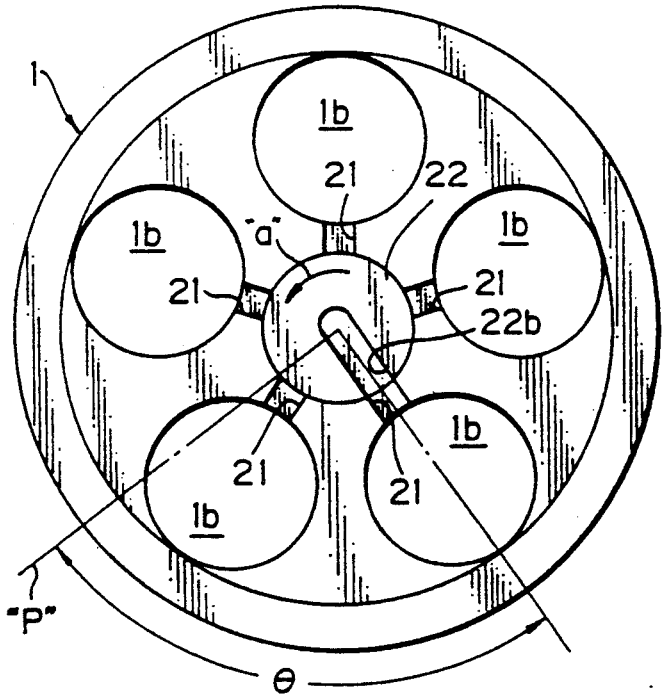
FIG. 4 is an end view of the cylinder block of the compressor of FIG. 1, illustrating an arrangement of cylinder bores and radial passageways provided therein.
Figure 5:
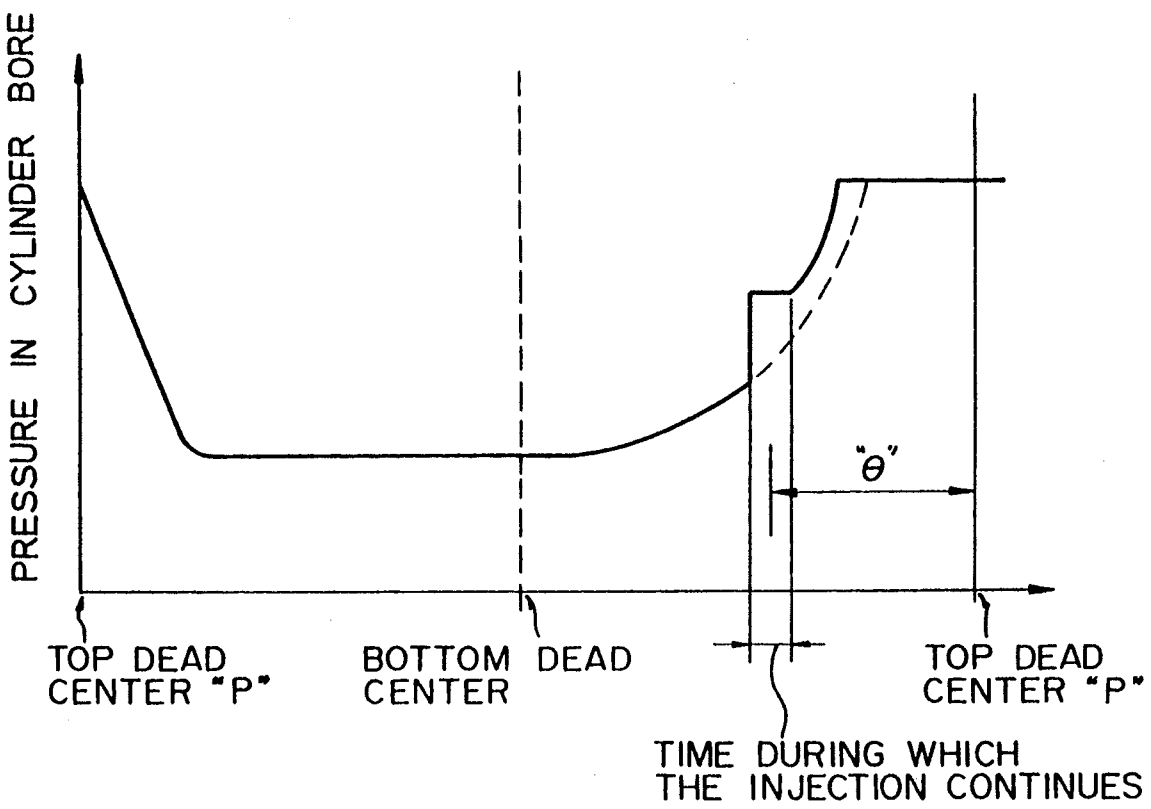
FIG. 5 is an explanatory diagram indicating a timing for carrying out an injection of a high pressure refrigerant gas into each cylinder bore; and, FIG. 6 is a schematic circuit diagram illustrating a refrigeration system in which a compressor capable of receiving an injection of a high pressure refrigerant gas is incorporated.

As best shown in FIGS. 2 and 3, one of the opposite end faces of the rotary valve element 22 is provided with a central bore 22*c* formed therein to be engaged with the end of the drive shaft 6 and a key groove 22*a* for receiving the above-mentioned key 23, and the other end face of the rotary valve element 22 is provided with a radial fluid passageway 22*b* recessed therein to extend from the center to the periphery. The radial fluid passageway 22*b* of the rotary valve element 22 is arranged to successively come into radial registration with each of the injection passageways 21 of the cylinder block 1 when the rotary valve element 22 is rotated together with the drive shaft 6 in a direction "a" shown in FIG. 4. Moreover, the rotary valve element 22 is fixed to the drive shaft 6 in such a manner that the above-mentioned radial registration of the fluid passageway 22*b* of the rotary valve element 22 with each of the injection passageways 21 of the cylinder block 1 occurs at a predetermined time when each of the pistons 15 is advanced from the bottom dead center thereof to a selected position before the top dead center thereof P in the cylinder bore 1*b* during the compression stroke thereof. As shown in FIG. 5, the positional discrepancy between the above-mentioned selected position and the top dead center of the piston 15 corresponds to an angular amount "$\theta$" in relation to the rotation of the rotary valve element 22. Namely, the angular amount "$\theta$" is chosen so that an injection of the refrigerant gas at high pressure appropriately occurs from the central bore 1*a* into each cylinder bore 1*b* in which the piston 15 proceeds from the bottom to top dead center thereof for carrying out compression of the refrigerant, via the fluid passageway 22*b* of the rotary valve element 22 and the injection passageway 21 of the cylinder block 1.

Figure 6:
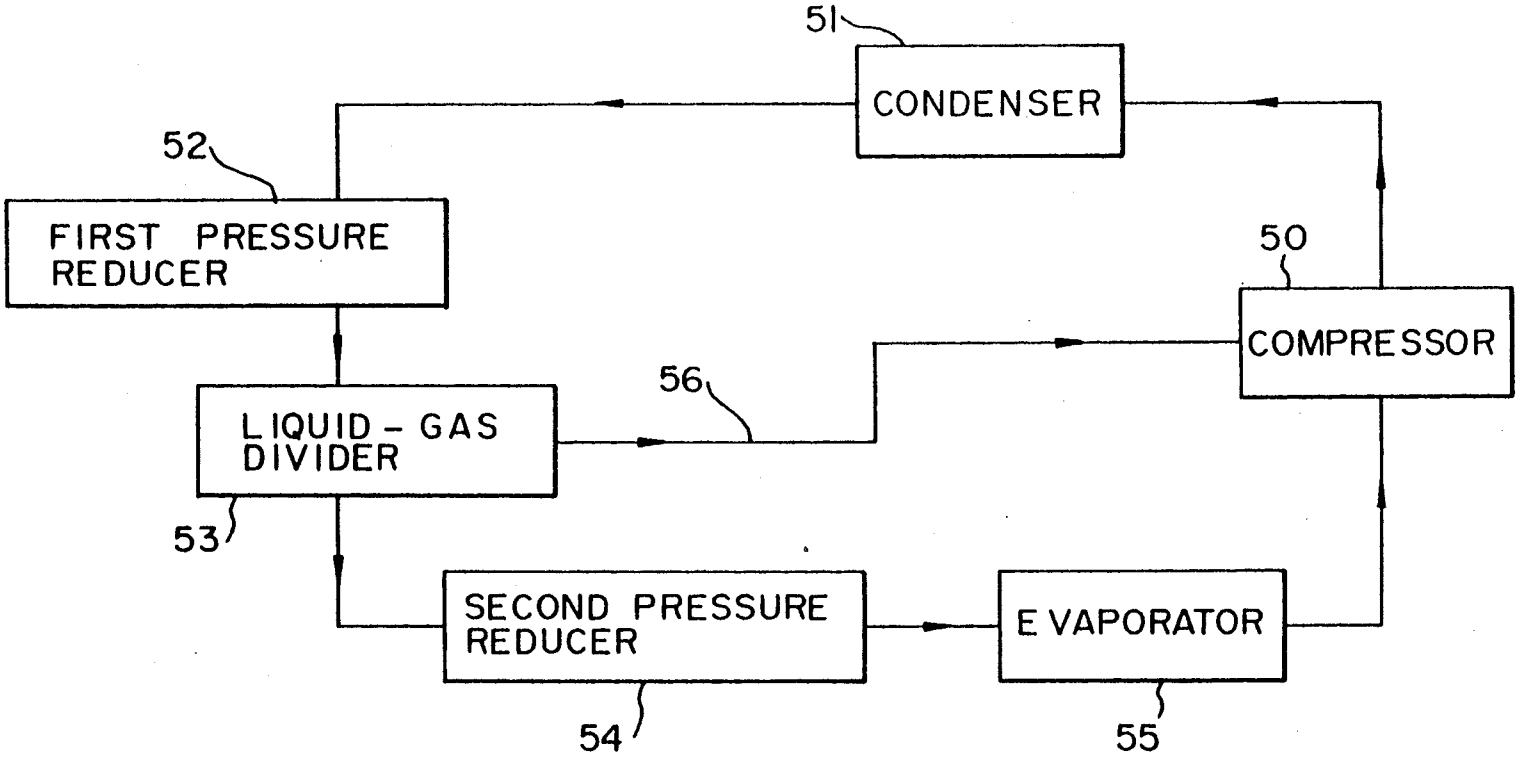

The above-described reciprocatory piston type compressor is incorporated in a refrigerating circuit of a refrigeration system similar to that shown in FIG. 6; the system of which performs an air refrigeration operation when used with an air-conditioner such as an automobile air-conditioner. Thus, the suction chamber 17 of the compressor is connected to an evaporator such as the evaporator 55, the discharge chamber 18 is connected to a condenser such as the condenser 51, and the fluid conduit 20 is connected to a liquid-gas divider such as the liquid-gas divider 53 via a refrigerant conduit.

The operation of the reciprocatory piston type compressor of FIG. 1 is described hereinbelow with reference to FIGS. 1 and 6.

When the compressor is driven so that the drive shaft 6 is rotated, the swash plate 9 is rotated together with the drive shaft 6 to perform a wobbling motion thereof, and accordingly the wobble plate 12 is non-rotatively wobbled to cause reciprocation of the pistons 15 in the respective cylinder bores 1*b*. Thus, in response to the reciprocation of the respective pistons 15, the refrigerant is drawn in the respective cylinder bores 1*b* from the suction chamber 17, compressed therein, and discharged therefrom toward the discharge chamber 18 of the rear housing 4.

The rotation of the drive shaft 6 rotates the rotary valve element 22, and therefore the fluid passageway 22*b* of the rotary valve element 22 successively comes into registration with one of the injection passageways 21 in a manner so that a fluid communication is created between the fluid conduit 20 and the cylinder bore lb in which the piston 15 carries out the compression stroke thereof for a certain time interval, via the registered fluid and injection passageways 22*b* and 21, and a portion of the central bore 1*a* of the cylinder block 1. Therefore, the refrigerant gas at high pressure introduced from the liquid-gas divider 53 into the fluid conduit 20 of the compressor is injected into the cylinder bore 1*b*, in which the piston 15 performs the compression stroke thereof. Namely, an injection of the refrigerant gas is made to increase the pressure level within the injected cylinder bore 1*b*.

When the rotary valve element 22 is rotated to a subsequent position at which the fluid passageway 22*b* of the rotary valve element 22 comes into radial registration with the subsequent injection passageway 21 opening toward the cylinder bore 1*b* next to the cylinder bore lb to which the injection of the refrigerant gas was applied, the injection of the high pressure refrigerant gas is similarly made to that subsequent cylinder bore 1*b* during the compression stroke. Accordingly, the rotation of the rotary valve element 22 eventually applies an equal injection of the refrigerant gas to every cylinder bore 1*b* at a predetermined time close to the termination of the compression stroke of that cylinder bore 1*b*.

The injection of the high pressure refrigerant gas made equally to every cylinder bore 1*b* of the compressor can improve total compression performance of the compressor, and accordingly the ability of the compressor to discharge the compressed refrigerant gas toward the refrigeration system is significantly enhanced. Further, the utilization of the refrigerant gas divided by the liquid-gas divider of the refrigeration system for the injection of the high pressure refrigerant gas into every cylinder bore of the multi-cylinder reciprocatory piston type compressor can increase the operational efficiency of the refrigeration system.

From the foregoing description, it should be understood that in accordance with the present invention a gas injection type refrigerant compressor capable of being incorporated in a refrigeration system can be constructed because of the provision of a simple valve element, i.e., the rotary valve element 22 without a cumbersome change in the internal construction of the conventional reciprocatory piston type multi-cylinder compressor.

Further, in the described embodiment of the present invention, the reciprocatory piston type compressor is provided with a plurality of single-headed pistons reciprocated by a wobble plate type rotation-to-linear motion converter. Nevertheless, it should be understood that the present invention will be equally applicable to a fixed inclination swash plate type compressor in which a plurality of double-headed pistons are reciprocated in a plurality of pairs of front and rear cylinder bores arranged on both sides of a swash plate chamber of a cylinder block, in which a fixed inclination swash plate is rotated together with an axial drive shaft. In the fixed inclination swash plate type compressor, the front and rear cylinder bores must be provided with respective front and rear rotary valve elements and front and rear injection passageways in a symmetrical arrangement so as to permit the injection of a high pressure refrigerant gas into these front and rear cylinder bores during the alternate compression stroke s of respective double-headed pistons. Namely, the compression stroke in each front cylinder bore and that in each rear cylinder bore occur to be out of phase with one another by an angle of 180 degrees during one revolution of the drive shaft. Therefore, it is necessary for the front and rear rotary valve elements to be attached to the opposite ends of the drive shaft so that the injection of the refrigerant gas to the front cylinder bore occurs 180 degrees in advance or behind the injection of the refrigerant gas to the rear cylinder bore.

It should be understood that further modifications and variations of the present invention will occur to persons skilled in the art without departing from the scope and sprit of the invention as claimed in the appended claims.

We claim:

1. A reciprocatory piston type refrigerant compressor to be incorporated in a refrigeration system provided with a condenser condensing a refrigerant, a first pressure reducer reducing a pressure level of the refrigerant condensed by the condenser, a liquid-gas divider diving the refrigerant depressurized by the first pressure reducer into a liquid refrigerant and a refrigerant gas, a second pressure reducer reducing a pressure level of the liquid refrigerant supplied from the liquid-gas divider, an evaporator for evaporating the refrigerant gas depressurized liquid refrigerant, and a refrigerant conduit line for supplying the refrigerant gas from the liquid-gas divider toward the compressor, comprising:

an axially extended cylinder block having a central axis thereof, a central bore extended coaxial with the central axis, and a plurality of axial cylinder bores arranged around the central axis parallel with the central axis of the cylinder block; each axial cylinder bore having first and second opposite ends thereof;

front and rear housings air-tightly connected to opposite axial ends of said axially extended cylinder block for defining a suction chamber for the refrigerant before compression, and a discharge chamber for the refrigerant after compression;

a rotatable drive shaft having axial ends thereof rotatably supported by bearings seated in said front housing and said central bore of said cylinder block;

a plurality of reciprocatory pistons fitted in said plurality of axial cylinder bores of said axially extended cylinder block; each piston being slid from the first to second end of one of said plurality of cylinder bores for drawing the refrigerant before compression, and from the second to first end of the same cylinder bore for compressing the drawn refrigerant gas;

a swash plate-operated piston drive mechanism arranged around the drive shaft so as to be cooperative with the drive shaft for reciprocating said plurality of reciprocatory pistons in said plurality of cylinder bores when said drive shaft is rotated;

first means for providing a constant refrigerant conduit introducing the refrigerant gas supplied from said liquid-gas divider of said refrigeration system into a definite part of said central bore of said cylinder block; and second means for successively creating a radial fluid communication passageway means between said definite part of said central bore of said cylinder block and each of said plurality of cylinder bores at a portion adjacent to the first end thereof in response to the rotation of said drive shaft; said radial fluid communication passageway means permitting an injection of the refrigerant gas from the definite part of the central bore into said portion of each cylinder bore adjacent to the first end thereof when said piston is at a compression stroke thereof.

2. A reciprocatory piston type refrigerant compressor according to claim 1, wherein said second means comprises:

a plurality of radial passageways fixedly formed in said cylinder block to provide a constant communication between said central bore of said cylinder block and said plurality of cylinder bores, and a rotary valve element arranged in said central bore of said cylinder block to be rotatable together with said drive shaft; said rotary valve element having an end face provided with a single radial passageway recessed in said end face to form said definite part of said central bore; said single radial passageway of said rotary valve element capable of successively coming into registration with one of said plurality of radial passageways of said cylinder block in response to the rotation of said rotary valve element.

3. A reciprocatory piston type refrigerant compressor according to claim 2, wherein said rotary valve element arranged in said central bore of said cylinder block is keyed to said drive shaft so as to be rotatable together with said drive shaft.

4. A reciprocatory piston type refrigerant compressor according to claim 1, wherein said first means comprises an axial through-bore formed in said rear housing; said axial through-bore being in communication with said refrigerant conduit line of said refrigeration system and with said central bore of said cylinder block.

* * * * *